US006347188B2

(12) United States Patent
Roffey

(10) Patent No.: US 6,347,188 B2
(45) Date of Patent: Feb. 12, 2002

(54) SMOKE GENERATOR

(75) Inventor: Ian David Roffey, Kent (GB)

(73) Assignee: Le Maitre Ltd., Surrey (GB)

( * ) Notice: Subject to any disclaimer, the term of this patent is extended or adjusted under 35 U.S.C. 154(b) by 0 days.

(21) Appl. No.: 09/485,481

(22) PCT Filed: Sep. 7, 1998

(86) PCT No.: PCT/GB98/02691

§ 371 Date: Feb. 9, 2000

§ 102(e) Date: Feb. 9, 2000

(87) PCT Pub. No.: WO99/12620

PCT Pub. Date: Mar. 18, 1999

(30) Foreign Application Priority Data

Sep. 5, 1997 (GB) ..... 9718912

(51) Int. Cl.[7] ..... F22B 29/06
(52) U.S. Cl. ..... 392/397
(58) Field of Search ..... 392/397, 394, 392/396, 478, 480, 481, 482, 488, 489

(56) References Cited

U.S. PATENT DOCUMENTS 4,764,660 A 8/1988 Swiatosz
4,818,843 A 4/1989 Swiatosz
5,367,603 A * 11/1994 Wenrich et al. ..... 392/394
5,559,923 A 9/1996 Robelen
5,647,054 A * 7/1997 Jones ..... 392/397
5,870,524 A * 2/1999 Swiatosz ..... 392/397
5,937,141 A * 9/1999 Swiatosz ..... 392/397

FOREIGN PATENT DOCUMENTS

GB 2299005 9/1996
WO 92/19344 11/1992

* cited by examiner

*Primary Examiner*—Teresa Walberg
*Assistant Examiner*—Vinod D Patel
(74) *Attorney, Agent, or Firm*—Merchant & Gould P.C.

(57) ABSTRACT

A smoke generator in which a supply of smoke making fluid is caused to pass cyclically down tubing (20). In a heat exchanger, an electrical current is passed along the tubing to heat the tubing and a sensor (54) is arranged to sense the tube temperature. Electrical power is controlled to heat the tubing cyclically so that fluid in the tubing is burnt off, every cycle of the power being switched on or off, thus reducing clogging.

6 Claims, 2 Drawing Sheets

SMOKE GENERATOR

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A "MICROFICHE APPENDIX"

Not Applicable

BACKGROUND OF THE INVENTION

1. Field of the Invention

The present invention relates to a smoke generator.

Smoke generators typically used for the entertainment, including the lighting, industry, are well known and our Patent Application No PCT/GB91/02170 is an example.

2. Description of the Related Art

The entertainment industry requires for some purposes a nontoxic dense fogging which is produced by a low density mist. Of prime importance in the production of this mist is the use of a fluid characterised by low vapour pressure and a natural lack of absorption in air. Fluids which meet these characteristics are difficult to use because oxide residues produced during the smoke generation process lead to fouling of the generator conduits, particularly those within heat exchangers used in such generators. To clean these conduits it is common to split the generator which may be in a cast form. GB Patent Publication No 2 299 005 A (Dragerwerk AG) mentions the case where fluid is continuously vaporised which is conventional. The drawback of continuous flow where a low mass heating tube is concerned is that the flow regime in forced convection is very complex and random resulting in hot spots and uncontrollable and undesirable conditions. The '005A patent application seeks to overcome this but clogging may still occur.

BRIEF SUMMARY OF THE INVENTION

Thus a smoke generator according to the invention comprises a smoke fluid supply means, a conduit in a heat exchanger connected to the supply means, the supply means being arranged to force the smoke fluid through the exchanger to a smoke outlet, wherein the heat exchanger comprises a length of electrically conductive tubing, with electrical connections spaced along the length arranged so that an electrical current may be passed along the tubing, the electrical resistance of the tubing being such that heat is generated along the tubing by the passage of electricity along the length, wherein a temperature sensor is arranged to sense the tube temperature and wherein control means is connected to the sensor and is so arranged to control an electrical supply to the electrical connections, said control means including means to cycle the electrical supply so that the power is switched on and off at a rate to allow residual fluid in the tubing to boil off.

The provision of tubing and the associated heating arrangement avoid cleaning problems.

Preferably the tubing is made of stainless steel which may be covered with a suitable insulating material such as glass fibre. The temperature sensor may function by checking the resistance of the tubing.

The control means is preferably arranged to raise the heat of the tubing to about 300° C. and then switch off the supply to the connections and then to switch on the supply again with a cycle time of about 5 seconds. This ensures that without the introduction of further fluid any resident fluid within the tubing is boiled off. Further fluid in a small quantity suitably about 5% of the tubing volume from the supply means may then be supplied to the tubing at a suitable time preferably as the tubing temperature falls. In the preferred embodiment the control means is arranged to repeat the cycle of raising the temperature of the tubing and allowing it to fall. The provision of a one way valve at the upstream end of the tubing (that is the end toward the supply means and away from the outlet) ensures that as the fluid expands to vapour in the tubing it is ejected from the outlet without the requirement of a pump or inlet pressure as is usual. The tubing is preferably coiled for space reduction.

BRIEF DESCRIPTION OF THE SEVERAL VIEWS OF THE DRAWINGS

An embodiment of the invention will now be described by way of example.

DETAILED DESCRIPTION OF THE INVENTION

Figure 1:
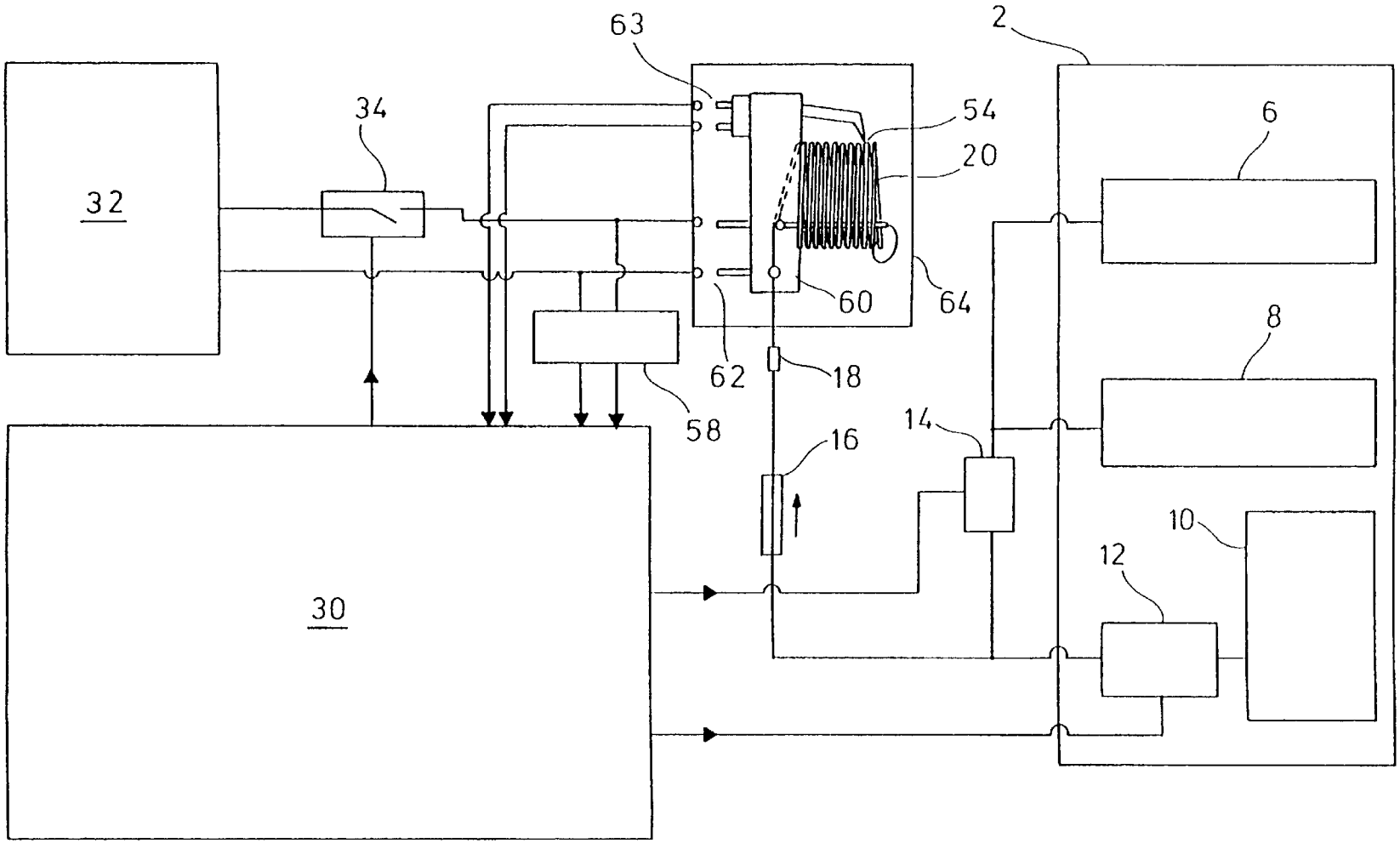
FIG. 1 is a diagram of a smoke generator according to the invention.
Figure 2:
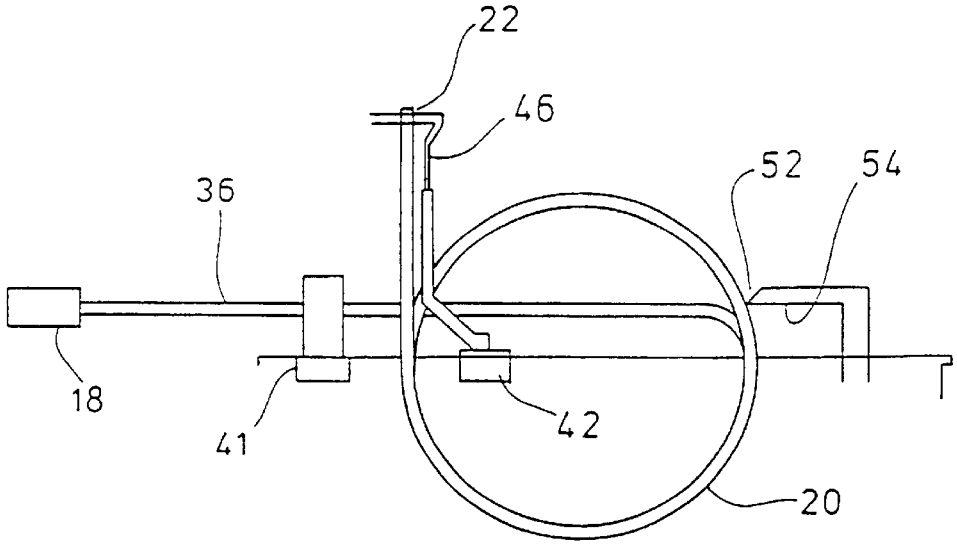
FIG. 2 is a diagram of heat exchanger arrangements for the generator of FIG. 1
Figure 3:
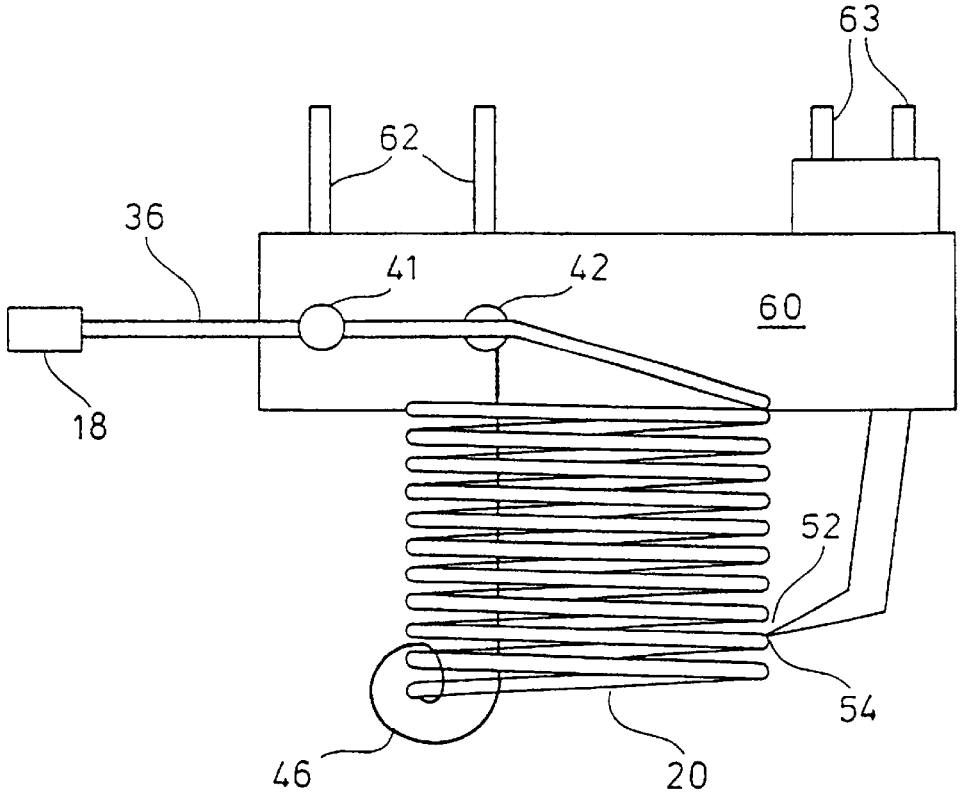
FIG. 3 is a further diagram of the exchanger arrangements of FIG. 2.

In the drawings a fluid supply means is provided generally at 2 and includes either a pressurised canister 4 of smoke generating fluid typically 20% water and 80% glycerine with the necessary propellant 6. Alternatively the supply means may include a pressurisable reservoir 8 for the fluid to be pumped up by an external supply or lastly an unpressurised reservoir 10 which uses a pump 12 to convey fluid. Whichever arrangement is used and solenoid valve 14 enables switching from one supply to another, the supply means 2 feeds through a one-way valve 16 to a heat exchanger inlet coupling 18 and thence to a coil 20 of tubing at the end of a length of which is output 22 from which vapour is forced out under pressure of expanding fluid in the coil.

The generator has a controller 30 and a low voltage electrical power source 32 to supply power via switch 34 to between terminal 41 adjacent the input end 36 of tubing 20 and terminal 42. Terminal 41 is connected directly to the tubing by fixing 44. Terminal 42 is connected to the output 22 of the tubing via a length of 0.6 mm diameter nichrome heater wire 46. This connection to the outlet avoids heat transference from the output to terminal 42 and helps to avoid heat loss at the output. The heater wire should be of similar thermal resistivity characteristics to the tubing.

The tubing is about 180 cm long and made of 304 Type Stainless Steel of about 0.1 to 0.2 mm wall thickness and 1.65 mm diameter covered with a high temperature grade glass polyamide laminate for insulation. This is coiled into a coil about 9 cm in diameter and 7 ½ cm in coiled length.

Toward the outlet end 50 of the tubing at 52 suitably about 5 to 7 cm from the outlet a sensor 54 is connected. The sensor is preferably a K type thermocouple or alternatively a 40 resistant bridge is used.

The electrical low voltage power source 32 supplies 200 VA at 24 volts sufficient to heat the tubing to 300° C. in 5 to 10 seconds. The controller 30 is arranged to cycle the power input every 5 seconds so that there is a continued power on, power off cycling which enables residual fluid to boil off. The controller 30 may be either discrete or a microprocessor and controls switch 34 so that a predetermined temperature monitored by sensor 54 power is removed from coil 20. At a second and lower temperature a required replenishment of fluid is injected. Power is fed to the controller via resistance bridge 58. Fluid is injected to the tubing in small amounts as the heat falls. The amount being about 5% of tube volume producing an active constituent fluid output of 0.002777 cc/sec or vapour output of 200/3600 cc/sec. The fluid used is typically 8 to 10 times normal concentrate. At a third temperature lower than the second temperature power is reapplied to the coil.

The coil 20 is mounted on an insulating holder 60 and has coil power connections 62 and sensor connections 63 so that the holder can be unplugged from the generator frame 64 for replacement, repair or refurbishment.

While this invention has been described with reference to a particular embodiment, it is of course understood that this description is not to be construed in a limiting sense. Various modifications of the disclosed embodiment may be apparent to persons skilled in the art upon reference to this description without departing from the spirit of the invention.

What is claimed is:

1. A smoke generator comprising a smoke fluid supply means, a heat exchanger comprising a length of electrically conductive tubing, the tubing comprising electrical connections spaced along a length of the tubing, the electrical connections being arranged so as to enable an electrical current to pass along the tubing, the electrical resistance of the tubing being such that a passage of electricity through the tubing generates heat a conduit disposed in the heat exchanger and connected to the supply means, a smoke outlet connected to the conduit, a temperature sensor adapted to sense a temperature of the tubing, control means connected to the sensor, the control means being adapted to control a supply of electricity to the electrical connections, the control means being adapted to cycle the supply of electricity on and off at a rate to allow residual fluid in the tubing to boil off.

2. A generator as claimed in claim 1, wherein the tubing comprises stainless steel.

3. A generator as claimed in claim 1, further comprising a one way valve disposed between the heat exchanger and the fluid supply means.

4. A generator as claimed in claim 1, wherein one of the electrical connections is connected to the tubing proximate the smoke outlet by a length of material having similar thermal resistivity characteristics to the tubing.

5. A smoke generator according to claim 4, wherein the length of material comprises nichrome.

6. A generator as claimed in claim 1 wherein the control means are adapted to cycle the supply of electricity on and off every 5 seconds.

* * * * *